US012535082B2

(12) United States Patent
Haddeman et al.

(10) Patent No.: US 12,535,082 B2
(45) Date of Patent: Jan. 27, 2026

(54) CENTRIFUGAL FAN ARRANGEMENT

(71) Applicant: ZEHNDER GROUP INTERNATIONAL AG, Gränichen (CH)

(72) Inventors: Martijn Haddeman, Epe (NL); Eric Arends, Zwolle (NL); Rene Brink, 't Harde (NL)

(73) Assignee: ZEHNDER GROUP INTERNATIONAL AG, Gränichen (CH)

( * ) Notice: Subject to any disclaimer, the term of this patent is extended or adjusted under 35 U.S.C. 154(b) by 3 days.

(21) Appl. No.: 18/017,237

(22) PCT Filed: Jul. 19, 2021

(86) PCT No.: PCT/EP2021/070134
§ 371 (c)(1),
(2) Date: Jan. 20, 2023

(87) PCT Pub. No.: WO2022/018020
PCT Pub. Date: Jan. 27, 2022

(65) Prior Publication Data

US 2023/0296109 A1 Sep. 21, 2023

(30) Foreign Application Priority Data

Jul. 24, 2020 (CH) ..... 922/20

(51) Int. Cl.
*F04D 29/42* (2006.01)
*F04D 17/10* (2006.01)
*F04D 27/00* (2006.01)

(52) U.S. Cl.
CPC ..... *F04D 29/4226* (2013.01); *F04D 17/10* (2013.01); *F04D 27/001* (2013.01)

(58) Field of Classification Search
CPC ..... F04D 29/4226; F04D 17/10; F04D 27/001
See application file for complete search history.

(56) References Cited

U.S. PATENT DOCUMENTS 6,241,463 B1 6/2001 Bahner et al.
2010/0307498 A1* 12/2010 Jones ..... F04D 29/601 128/204.21

(Continued)

FOREIGN PATENT DOCUMENTS

GB 1 419 591 A 12/1975
JP S61-229999 A 10/1986

OTHER PUBLICATIONS

EPO (Riswijk, NL), English language version of the International Search Report, Form PCT/ISA/210, for International Application PCT/EP2021/070134, Feb. 7, 2022 (6 pages).

(Continued)

*Primary Examiner* — Nathaniel E Wiehe
*Assistant Examiner* — Jackson N Gillenwaters
(74) *Attorney, Agent, or Firm* — Pauley Erickson & Swanson

(57) ABSTRACT

A centrifugal fan arrangement includes a centrifugal fan rotatably mounted within a scroll housing and a plurality of circumferentially spaced fan blades fixed to a central fan axle extending along an axial direction and/or to a circumferential fan ring extending in a plane orthogonal to an axial direction. The scroll housing includes a housing main portion with a maximum housing diameter D and a maximum axial housing width H, a housing inlet portion and a housing outlet portion, said housing main portion surrounding said centrifugal fan at radially outer locations to define a circumferentially extending air guiding space. The housing inlet portion is located at radially inner locations to define an inner air inlet space. The housing outlet portion is located at a radially outer location to define an air outlet space. A ratio (Continued)

D/H between said maximum housing diameter D of said housing main portion and said maximum axial housing width H of said housing main portion is between 20/10 and 35/10, preferably between 25/10 and 32/10.

14 Claims, 4 Drawing Sheets

(56) References Cited

U.S. PATENT DOCUMENTS

| | | | | |
|---|---|---|---|---|
| 2011/0250051 | A1 | 10/2011 | Smiley, III et al. | |
| 2015/0300359 | A1 | 10/2015 | Kashihara et al. | |
| 2015/0335921 | A1 | 11/2015 | Hagen et al. | |
| 2017/0224940 | A1 | 8/2017 | Kenyon et al. | |
| 2018/0003382 | A1 | 1/2018 | Lyons et al. | |
| 2018/0274547 | A1 | 9/2018 | Hofmann et al. | |
| 2019/0186498 | A1* | 6/2019 | Haaf | G01F 1/115 |
| 2020/0208649 | A1 | 7/2020 | Kodam et al. | |

OTHER PUBLICATIONS

EPO (Riswijk, NL), Written Opinion of the International Searching Authority, Form PCT/ISA/237, for International Application PCT/EP2021/070134, Feb. 7, 2022 (14 pages).

* cited by examiner

CENTRIFUGAL FAN ARRANGEMENT

BACKGROUND OF THE INVENTION

Field of the Invention

The invention relates to a centrifugal fan arrangement and in particular to a centrifugal fan arrangement to be integrated in a heat recovery ventilation unit.

SUMMARY OF THE INVENTION

It is an object of the invention to provide a compact centrifugal fan arrangement that lends itself to being integrated in a compact heat recovery ventilation unit.

DETAILED DESCRIPTION OF THE INVENTION

Figure 1:
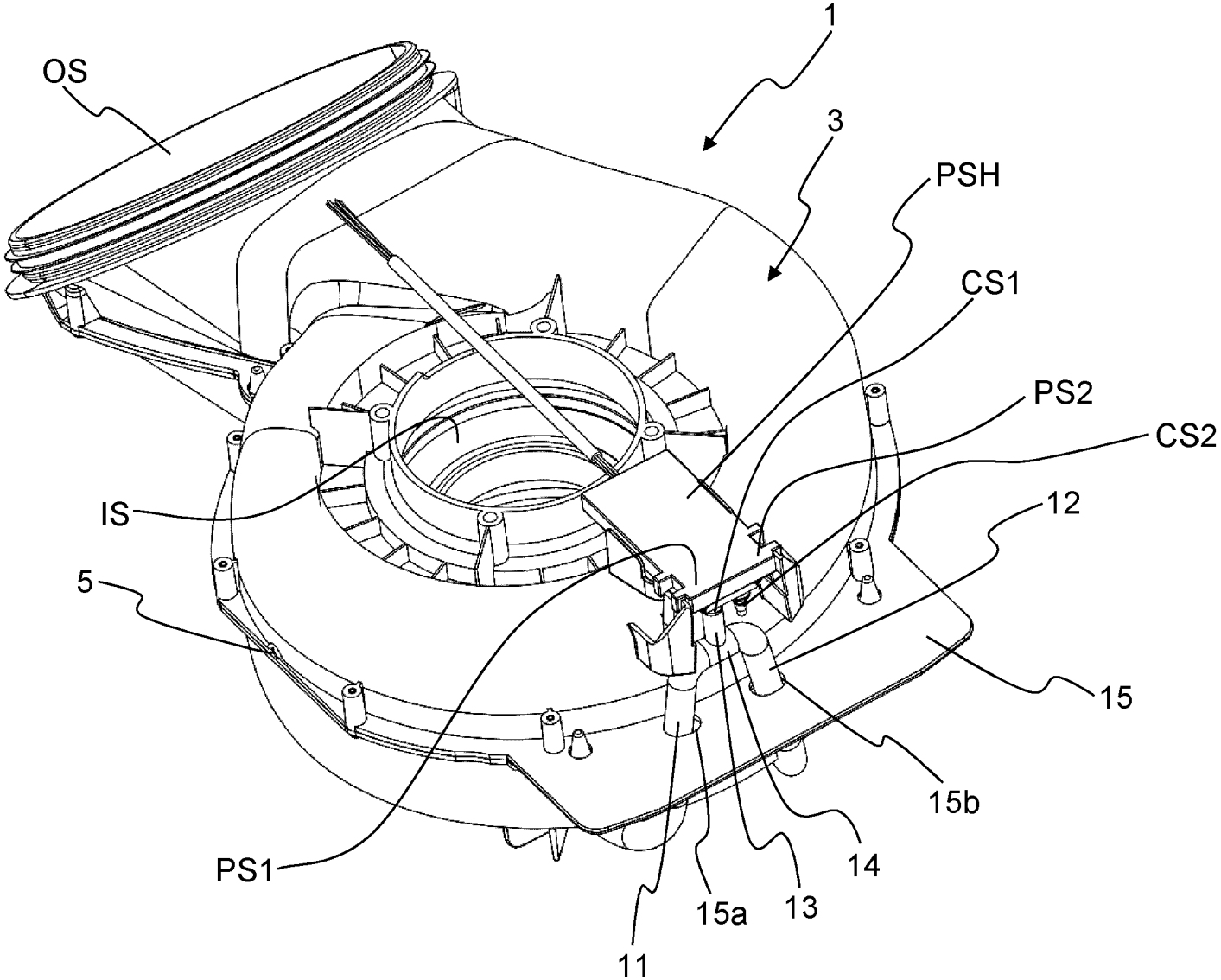
FIG. 1 shows a top perspective view of one embodiment.
Figure 2:
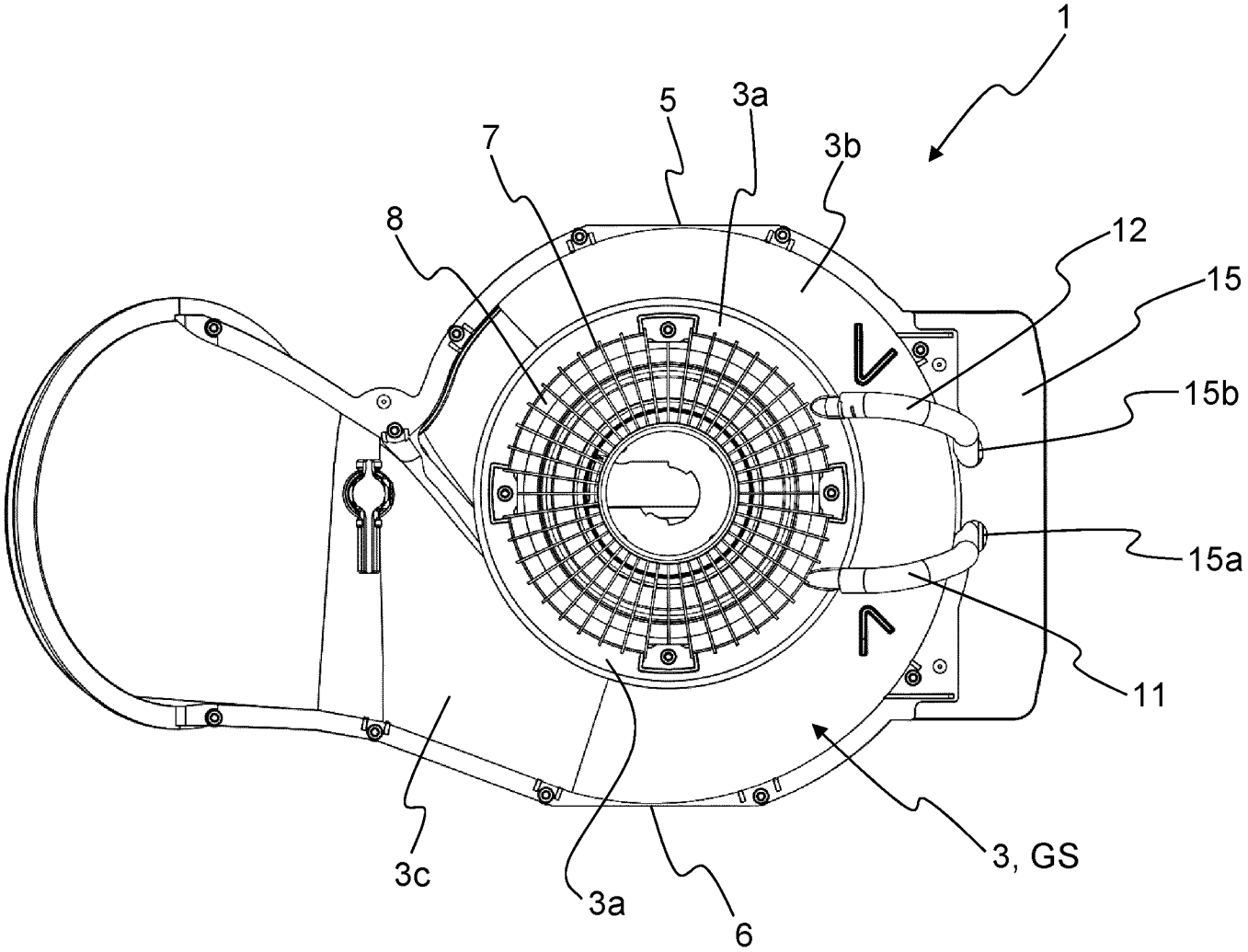
FIG. 2 shows a top view of the embodiment, shown in FIG. 1.
Figure 3:
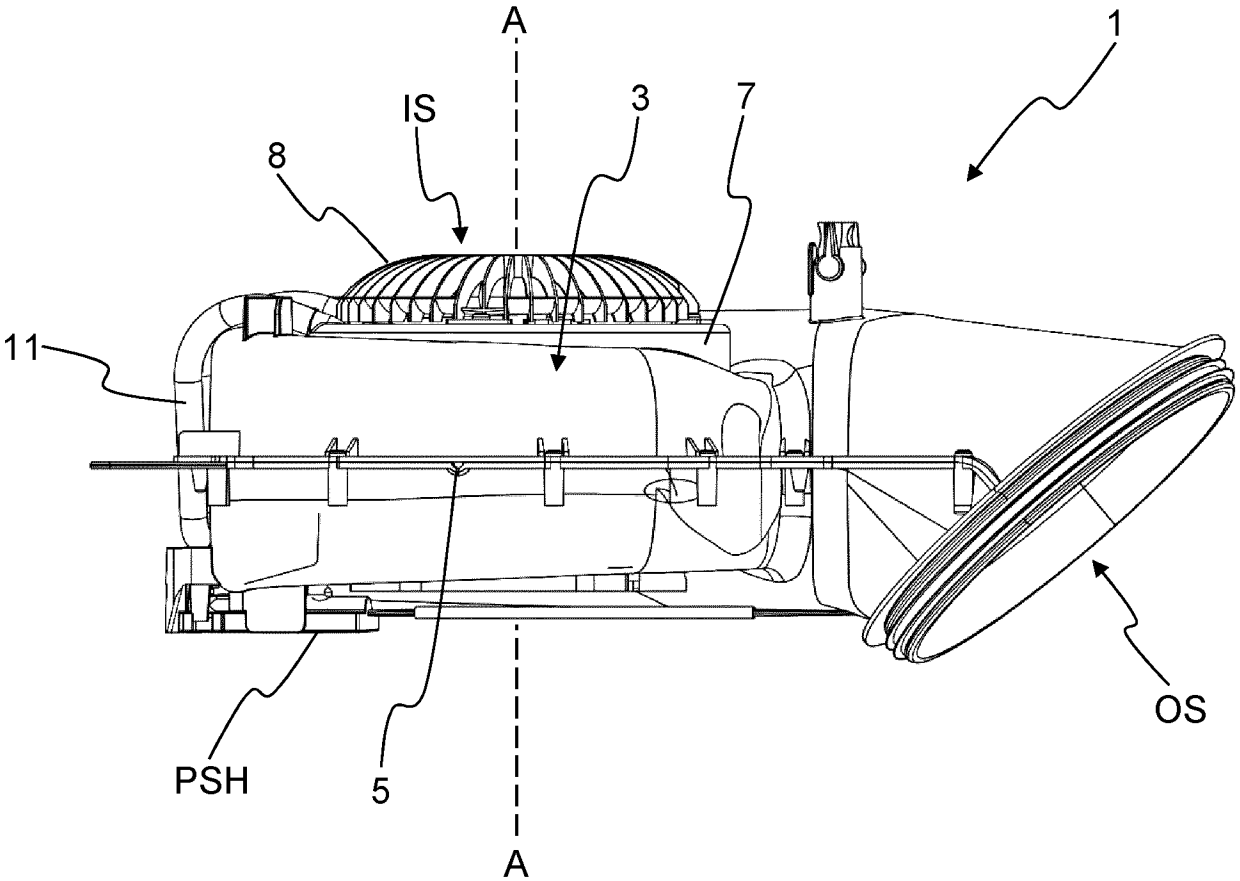
FIG. 3 shows one side view of the embodiment shown in FIG. 1.
Figure 4:
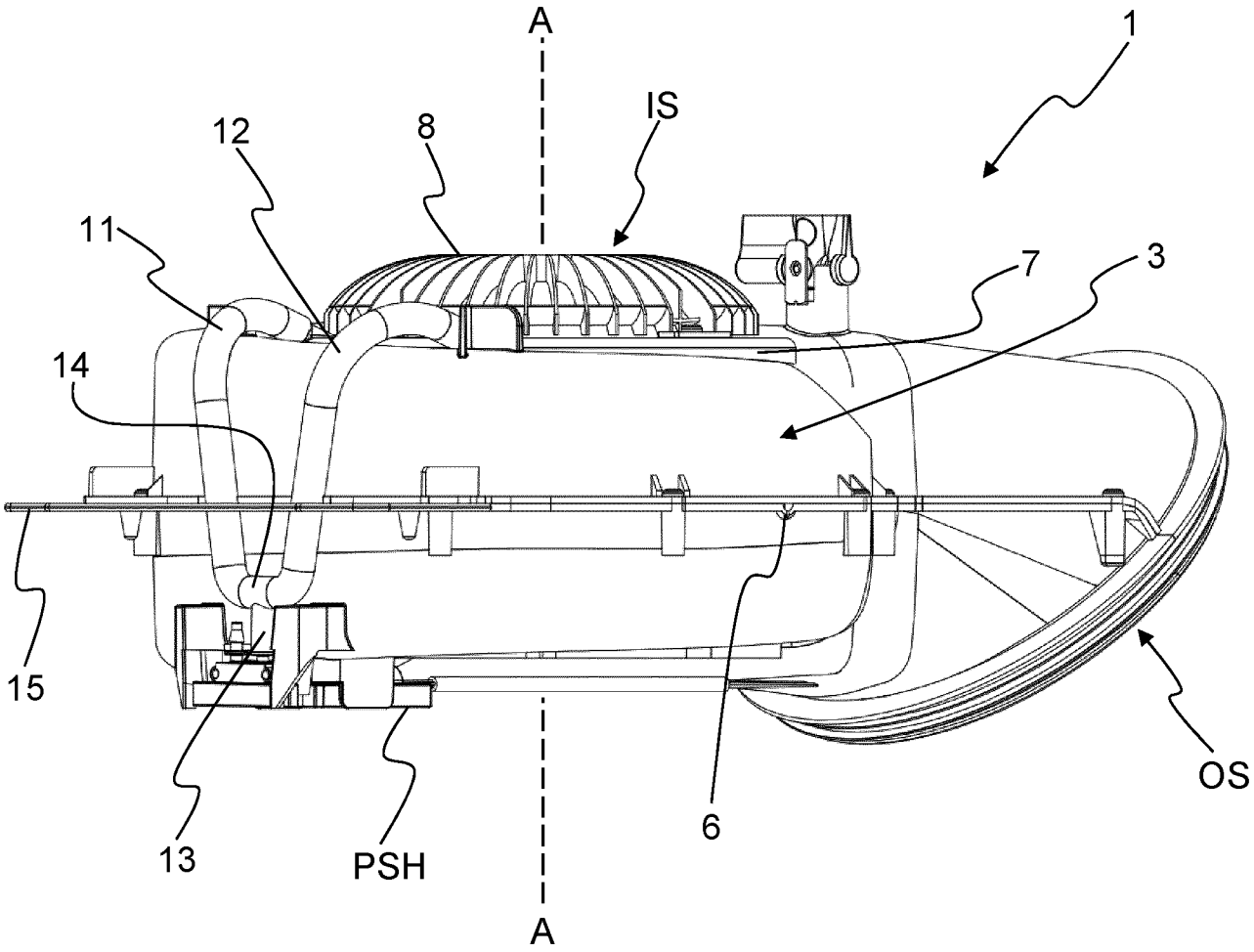
FIG. 4 shows an opposite side view of the embodiment shown in FIG. 1.

The invention provides a centrifugal fan arrangement comprising a centrifugal fan rotatably mounted within a scroll housing, wherein said centrifugal fan comprises a plurality of circumferentially spaced fan blades fixed to a central fan axle extending along an axial direction (axis of rotation of the fan) and/or to a circumferential fan ring extending in a plane orthogonal to an axial direction (axis of rotation of the fan), wherein said scroll housing comprises a housing main portion with a maximum housing diameter D and a maximum axial housing width H, a housing inlet portion and a housing outlet portion, said housing main portion surrounding said centrifugal fan at radially outer locations to define a circumferentially extending air guiding space, said housing inlet portion being located at radially inner locations to define an inner air inlet space, and said housing outlet portion being located at a radially outer location in order to define an air outlet space, characterized in that a ratio D/H between said maximum housing diameter D of said housing main portion and said maximum axial housing width Hof said housing main portion is comprised between 20/10 and 35/10, and preferably between 25/10 and 32/10. More preferably, said ratio is comprised between 15/10 and 35/10, and most preferably between 25/10 and 32/10.

As a result, the centrifugal fan arrangement according to the invention can be integrated in the housing of a heat recovery ventilation (HRV) unit with a flat housing where the housing has a given length and width and a thickness much smaller than the length or width. Due to its small D/H ratio, the centrifugal fan arrangement can be fitted in such a flat FIRV unit housing with its axial direction or the axis of rotation of the fan in a plane defined by the length and width directions of the housing, i.e., orthogonal to the direction defined by the thickness direction of the housing. Typically, such flat HRV units having such flat housings, enabled by the centrifugal fan arrangement of the invention, are installed at a ceiling or at a wall with the axis of rotation of the centrifugal fan arrangement being parallel to the ceiling surface or to the wall surface.

In some embodiments, the fan blades of the centrifugal fan arrangement may have a maximum axial blade width E and a maximum radial blade length F.

In some embodiments, the fan blades may be straight radial blades.

In some embodiments, the fan blades may be curved blades, either forward-curved blades or, preferably, backward-curved blades.

Preferably, a ratio E/H between said axial blade width E and said maximum axial housing width H is comprised between 2/10 and 8/10, and preferably between 3/10 and 6/10. Preferably, a ratio g/E between a radial gap g between an inner surface of said housing main portion and a radial end of said blades on the one hand, and said maximum radial blade width E is comprised between 1/10 and 12/10, and preferably between 2/10 and 8/10.

Preferably, a ratio g/F between a radial gap g between an inner surface of said housing main portion and a radial end of said blades on the one hand, and said maximum radial blade length F is comprised between 1/20 and 10/20, and preferably between 1/20 and 5/20.

Preferably, said fan blades are rectangular blades having an axial blade width E and a radial blade length F.

Preferably, said centrifugal fan comprises six to twelve circumferentially spaced fan blades. Preferably, said housing outlet portion comprises an outlet duct portion having a bend. Preferably, said bend has a bend angle comprised between 0° and 60°, more preferably between 10° and 50°, even more preferably between 10° and 50°, and most preferably between 20° and 40°.

In a preferred embodiment, said bend has a bend angle of 30°. The centrifugal fan arrangement may comprise drainage holes.

Preferably, drainage holes are located in a wall portion of said scroll housing.

Preferably, two drainage holes are located on a maximum diameter circumferential line of said scroll housing at diametrically opposite locations.

As a result, the centrifugal fan arrangement can be arranged in a first way with one of the two drainage holes at a lowermost position of the centrifugal fan arrangement and with said bend facing in a first direction, or it can be arranged in a second way with the other one of the two drainage holes at the lowermost position of the centrifugal fan arrangement and with said bend facing in a second direction which may be opposite to said first direction.

Preferably, a local inner cross sectional area of said scroll housing increases from an inlet of said scroll housing to an outlet of said scroll housing.

Preferably, a local inner axial width of said scroll housing increases from an inlet of said scroll housing to an outlet of said scroll housing. More preferably, only the local inner axial width of said scroll housing increases from the inlet of said scroll housing to the outlet of said scroll housing while a local inner radial width of said scroll housing is substantially constant from the inlet to the outlet of said scroll housing.

As a result, the increase of the inner cross sectional area of said scroll housing can be achieved with a lesser increase of the radial width of aid scroll housing or even with no increase of the radial width of said scroll housing. Again, this contributes to a smaller maximum housing diameter D of said housing main portion and a smaller D/H ratio of the centrifugal fan arrangement according to the invention.

Nevertheless, a local inner radial width of said scroll housing may increase from an inlet of said scroll housing to an outlet of said scroll housing.

Preferably, two drainage holes are located at a location of maximum diameter of said scroll housing, one of said holes being located in a first wall portion and the other of said holes being located in a second wall portion diametrically opposite to said first wall portion.

Preferably, said centrifugal fan arrangement comprises pressure sensor means for measuring air pressure within and/or outside said centrifugal fan arrangement.

Preferably, said pressure sensor means comprises a ring duct with circumferentially spaced holes e.g., a flow ring, in fluid connection with a pressure sensor and circumferentially extending along an inner wall of said duct portion for spatially averaged air pressure measurement. Preferably, these holes are slits in the inner wall of said duct portion. The slits may be straight slits extending along the circumferential direction or extending in the axial direction. Alternatively, the slits may extend in a direction having a circumferential component and an axial component. Instead of circumferentially spaced holes, said pressure sensor means may comprise a ring duct with a continuous slit extending around the entire circumference of the inner wall of said duct portion.

As a result, the local air pressure at each of these circumferentially spaced holes contributes to the averaged air pressure contacting the pressure sensor.

Preferably, an axial flow grid having walls extending in said axial direction is located at said radially inner locations which define said inner air inlet space, said axial flow grid covering said inner air inlet space.

As a result, the air flow entering said centrifugal fan arrangement is more uniform.

In some embodiments, the ring duct, e.g., flow ring, may be located around said inner air inlet space between said scroll housing and said flow grid.

Preferably, first indentations are provided in an edge of said ring duct, e.g., flow ring, interfacing with said scroll housing and/or second indentations are provided in an edge of said scroll housing interfacing with said ring duct/flow ring.

Preferably, said scroll housing comprises a first ring-shaped formation and said flow grid comprises a second ring-shaped formation complementary to said first ring-shaped formation and interfacing therewith, said first and second ring-shaped formations together forming said ring duct when said scroll housing and said flow grid are assembled along their interfacing port ions.

Preferably, first indentations are provided in an edge of said first ring-shaped formation interfacing with said second ring-shaped formation and/or second indentations are provided in an edge of said second ring-shaped formation interfacing with said first ring-shaped formation.

In some embodiments, the ring duct, e.g., flow ring, may be located around said inner air inlet space in said scroll housing. Preferably, a pressure sensor is located outside a duct portion of said centrifugal fan arrangement.

As a result, said pressure sensor, which may be a first pressure sensor, will measure air pressure outside said duct portion where there is no or very little air movement. Due to the absence of air flow, a pressure measurement by said first pressure sensor will typically be measurement of static pressure.

Preferably, said circumferentially spaced holes and a pressure sensor are connected by pressure sensor air duct portions located outside said duct portion of said centrifugal fan arrangement.

As a result, said pressure sensor, which may be a second pressure sensor, i.e., a sensor being different from the first sensor, will measure air pressure inside said duct portion where there is air movement. Depending on the orientation of said holes with respect to the direction of airflow, a pressure measurement by said second pressure sensor can be a measurement of static pressure, dynamic pressure or a combination thereof.

Preferably, said pressure sensor air duct portions are made of an elastomeric material, e.g., silicone. The pressure sensor air duct portions may be hoses which can be easily bent and adapted to their installation environment.

Silicone is a preferred material for said pressure sensor air duct portions.

Preferably, silicone tubes are used since dust particles and water droplets do not tend to stick to the silicone surface inside the silicone tubes. This helps prevent the formation of biofilms inside said pressure sensor air duct portions or tubes. Preferably, a minimum internal width of said pressure sensor air duct portions, e.g., the internal diameter of tubes, is greater than 8 mm. This helps prevent condensed water, e.g., water droplets, from blocking said pressure sensor air duct portions.

Preferably, said pressure sensor means comprises a first pressure sensor for measuring air pressure outside a duct portion of said centrifugal fan arrangement and a second pressure sensor for measuring air pressure inside said duct portion of said centrifugal fan arrangement.

This combination of first and second pressure sensors can be used to provide respective pressure measurements which can be used to determine instantaneous airflow velocity or instantaneous air flow within said centrifugal fan arrangement which can be integrated over a given period of time to obtain cumulated air flow during said time period.

Preferably, said first pressure sensor and said second pressure sensor are arranged as static air pressure sensors.

However, as mentioned before, said second pressure sensor for measuring inside air pressure may be fluidly connected to the inside of said duct portion in different ways, e.g., hole orientations with respect to airflow direction within said duct, in order to measure static pressure, dynamic pressure or any combination thereof within said duct portion.

Preferably, both said first pressure sensor and said second pressure sensor are located in a pressure sensor housing located outside said centrifugal fan arrangement.

This provides protection of the sensors and sensor electronics from water, dust, etc.

Preferably, said pressure sensor housing comprises a first connecting formation for connecting said pressure sensor air duct portions, located outside said duct portion, to said first pressure sensor located in said pressure sensor housing. This first connecting formation may be a nipple or pipe socket to be engaged by an end of said pressure sensor air ducts.

These pressure sensor air ducts provide further protection of the sensors and sensor electronics from water, dust, etc.

Preferably, said pressure sensor housing comprises a second connecting formation for connecting a further pressure sensor air duct portion, located outside said duct portion, to said second pressure sensor located in said pressure sensor housing. Again, this first connecting formation may be a nipple or pipe socket to be engaged by an end of said pressure sensor air ducts.

Preferably, said pressure sensor air duct portions located outside said duct portion of said centrifugal fan arrangement comprise a junction, preferably a T-junction or a Y-junction, where a first pressure sensor air duct portion connected to a first hole of said circumferentially spaced holes, a second pressure sensor air duct portion connected to a second hole of said circumferentially spaced holes and a third pressure sensor air duct portion connected to said first pressure sensor are all fluidly connected to each other. The third pressure sensor is typically different from the first and second pressure sensor.

As a result, the centrifugal fan arrangement can be positioned such that the third pressure sensor air duct is oriented horizontally. This helps prevent condensation water droplets and dust particles from entering said third pressure sensor air duct. Advantageously, the centrifugal fan arrangement can be positioned such that said third pressure sensor air duct portion is oriented horizontally while an end portion of said first pressure sensor air duct portion within said junction and an end portion of said second pressure sensor air duct port ion within said junction are oriented vertically. This also helps prevent condensation water droplets and dust particles from entering said third pressure sensor air duct portion.

Preferably, said third pressure sensor air duct portion has a smaller cross section than said first and second pressure sensor air duct portions.

Again, this helps prevent condensation water droplets and dust particles from entering said third pressure sensor air duct portion.

If said first pressure sensor and said second pressure sensor are arranged as static air pressure sensors, the static air pressure measured by said second pressure sensor inside said duct portion where there is air movement will be smaller than static air pressure of stagnant air. Therefore, if condensation water droplets and dust particles have entered said third pressure sensor air duct portion, e.g., in a stagnant air environment during non-operation of the centrifugal fan arrangement, the lower static air pressure will tend to suck these condensation water droplets and dust particles out of said third pressure sensor air duct portion when the fan of the centrifugal fan arrangement is turned on again after having been turned off for a period of time (non-operation).

Preferably, said housing main portion comprises an outside formation extending away from the outside of said housing main portion.

This outside formation can be used for holding the centrifugal fan arrangement in a defined position within a HRV unit, e.g., by inserting said outside formation in a complementary hole formation in a wall portion or thermal/acoustic insulation portion of said HRV unit or by clamping said outside formation between two wall portions or thermal/acoustic insulation portions of said HRV unit.

Preferably, said outside formation is a plate-type formation.

Preferably, said plate-type formation extends adjacent to and beyond said second connecting formation for connecting a further pressure sensor air duct to said second pressure sensor located in said pressure sensor housing for measuring air pressure outside said centrifugal fan arrangement.

As a result, the plate-type formation helps reduce air flow around said second connecting formation by providing a windshield or umbrella function which is of particular interest if said second connecting formation is used in a "naked mode" without a further pressure sensor air duct connected to it. This prevents non-zero air speeds at said second connecting formation which is meant for static pressure measurements, thus preventing errors in determining air flow.

Preferably, said outside formation has through-holes for feeding through said pressure sensor air duct portions, preferably for feeding through said first and second pressure sensor air duct portions.

As a result, said pressure sensor air ducts, e.g., elastomer tubes, are fixed in place and less vulnerable to mechanical damage.

LIST OF REFERENCE SIGNS

1 centrifugal fan arrangement
2 centrifugal fan
3 scroll housing
3*a* scroll housing inlet portion
3*b* scroll housing main portion
3*c* scroll housing outlet portion
A axial direction (axis of fan rotation)
GS air guiding space
IS air inlet space
OS air outlet space
D maximum housing diameter (radial dimension)
H maximum housing width (axial dimension)
5 drainage hole
6 drainage hole
7 ring duct (flow ring)
8 flow grid
PSH pressure sensor housing
PS1 first pressure sensor (air pressure measurement outside the centrifugal fan arrangement)
PS2 second pressure sensor (air pressure measurement inside the centrifugal fan arrangement)
CS1 first connecting formation
CS2 second connecting formation
11 first pressure sensor air duct portion
12 second pressure sensor air duct portion
13 third pressure sensor air duct portion
14 junction (of pressure sensor air duct portions)
15 outside formation (plate)
15*a* through-hole
15*b* through-hole

The invention claimed is:

1. A centrifugal fan arrangement (1) comprising:

a centrifugal fan (2) rotatably mounted within a scroll housing (3), wherein said centrifugal fan comprises a plurality of circumferentially spaced fan blades fixed to a central fan axle extending along an axial direction (A) and/or to a circumferential fan ring extending in a plane orthogonal to the axial direction (A), wherein said scroll housing (3) comprises a housing main portion (3*b*) with a maximum housing diameter D and a maximum axial housing width H, a housing inlet portion (3*a*) and a housing outlet portion (3*c*), said housing main portion (3*b*) surrounding said centrifugal fan (2) at radially outer locations to define a circumferentially extending air guiding space (GS), said housing inlet portion (3*a*) being located at radially inner locations to define an inner air inlet space (1S), and said housing outlet portion (3*c*) being located at a radially outer location in order to define an air outlet space (OS), wherein the centrifugal fan arrangement (1) comprises a first pressure sensor (PS1) for measuring air pressure within and/or outside said centrifugal fan arrangement (1), wherein the first pressure sensor comprises a ring duct (7) with circumferentially spaced holes in fluid connection with the pressure sensor (PS1) and circumferentially extending along an inner wall of a duct portion for spatially averaged air pressure movement, wherein said first pressure sensor (PS1) is located outside the duct portion of said centrifugal fan arrangement, wherein said circumferentially spaced holes and said first pressure sensor (PS1) are connected by pressure sensor air duct portions (11, 12) located outside said duct portion of said centrifugal fan arrangement, and wherein said pressure sensor air duct portions (11, 12) located outside said duct portion of said centrifugal fan arrangement (1) comprise a junction (14) where a first pressure sensor air duct portion (11) connected to a first hole of said circumferentially spaced holes, a second pressure sensor air duct portion (12) connected to a second hole of said circumferentially spaced holes and a third pressure sensor air duct portion (13) connected to said first pressure sensor (PS1) are all fluidly connected to each other, wherein the third pressure sensor air duct portion (13) extends away from the junction in the axial direction (A).

2. A centrifugal fan arrangement as defined in claim 1, wherein said pressure sensor air duct portions (11, 12) are made of an elastomeric material.

3. A centrifugal fan arrangement as defined in claim 1, further comprising a second pressure sensor (PS2) for measuring air pressure inside said duct portion of said centrifugal fan arrangement.

4. A centrifugal fan arrangement as defined in claim 3, wherein said first pressure sensor (PS1) and said second pressure sensor (PS2) are arranged as static air pressure sensors.

5. A centrifugal fan arrangement as defined in claim 3, wherein both said first pressure sensor (PS1) and said second pressure sensor (PS2) are encapsulated in a pressure sensor housing (PSH) located outside said centrifugal fan arrangement.

6. A centrifugal fan arrangement as defined in claim 5, wherein said pressure sensor housing (PSH) comprises a first connecting formation (CF1) for connecting the third pressure sensor air duct portion (13), located outside said duct portion, to said first pressure sensor (PS1) located in said pressure sensor housing (PSH).

7. A centrifugal fan arrangement as defined in claim 5, wherein said pressure sensor housing (PSH) comprises a second connecting formation (CF2) for connecting a further pressure sensor air duct portion, located outside said duct portion, to said second pressure sensor (PS2) located in said pressure sensor housing (PSH).

8. A centrifugal fan arrangement as defined in claim 1, wherein said third pressure sensor air duct portion (13) has a smaller cross section than said first and second pressure sensor air duct portions (11, 12).

9. A centrifugal fan arrangement as defined in claim 1, wherein said housing main portion (3*b*) comprises an outside formation (15) extending away from the outside of said housing main portion (3*b*).

10. A centrifugal fan arrangement as defined in claim 9, wherein said outside formation (15) is a plate-type formation.

11. A centrifugal fan arrangement as defined in claim 10, wherein said plate-type formation (15) extends adjacent to and beyond said first pressure sensor (PS1) for measuring air pressure outside said centrifugal fan arrangement (1).

12. A centrifugal fan arrangement as defined in claim 10, wherein said outside formation (15) has through-holes (15*a*, 15*b*) for feeding through said pressure sensor air duct portions (11, 12).

13. The centrifugal fan arrangement (1) as defined in claim 1, wherein a ratio D/H between said maximum housing diameter D of said housing main portion and said maximum axial housing width H of said housing main portion (3*b*) is comprised between 20/10 and 35/10.

14. The centrifugal fan arrangement as defined in claim 1, wherein the junction (14) comprises one of a T-junction and a Y-junction.

* * * * *